US006138853A

United States Patent [19]

Frechette

[11] Patent Number: 6,138,853

[45] **Date of Patent: *Oct. 31, 2000**

[54] HAND PORTABLE FUEL CONTAINER WITH CLEANING OPENING

[76] Inventor: Ronald J. Frechette, 57 Denison Rd., North Stonington, Conn. 03659

[ * ] Notice: This patent issued on a continued prosecution application filed under 37 CFR 1.53(d), and is subject to the twenty year patent term provisions of 35 U.S.C. 154(a)(2).

[21] Appl. No.: 08/897,109

[22] Filed: Jul. 18, 1997

Related U.S. Application Data

[63] Continuation-in-part of application No. 08/699,144, Aug. 16, 1996, abandoned.

[51] Int. Cl.[7] ..... B65D 25/28; B65D 41/04; B63H 20/00

[52] U.S. Cl. ..... 220/212.5; 220/562; 220/4.13; 220/4.14; 220/288; 222/465.1; 222/482; 440/88; 440/113

[58] Field of Search ..... 220/562, 565, 220/567.2, 581, 582, 86.1, 288, 212, 212.5, 4.12–4.15, 905, 756, 766, 768, 769, 771, 772, 632, 635; 222/465.1, 482, 481, 478, 469; 440/88, 113

[56] References Cited

U.S. PATENT DOCUMENTS

| | | | |
|---|---|---|---|
| 2,750,769 | 6/1956 | Yost et al. | 220/632 |
| 3,438,538 | 4/1969 | Peters | 220/288 |
| 3,746,200 | 7/1973 | Flider | 222/482 X |
| 3,918,582 | 11/1975 | Wallace | 220/288 X |
| 4,294,372 | 10/1981 | Onishi | 220/86.1 X |
| 4,557,395 | 12/1985 | DeLay, Jr. | 220/86.1 |
| 4,773,561 | 9/1988 | Sedam | 220/373 X |
| 4,832,641 | 5/1989 | Oishi et al. | 4440/88 |
| 4,923,098 | 5/1990 | Schoonover et al. | 222/465.1 |
| 4,972,972 | 11/1990 | Goguen | 222/465.1 X |
| 5,469,985 | 11/1995 | Furuichi et al. | 220/632 |
| 5,544,777 | 8/1996 | Watson | 220/4.13 |
| 5,749,485 | 5/1998 | Chiu | 220/735 X |
| 5,855,304 | 1/1999 | Dean et al. | 222/481 |

FOREIGN PATENT DOCUMENTS

| | | | |
|---|---|---|---|
| 254468 | 5/1963 | Australia | 222/465.1 |
| 457121 | 11/1991 | European Pat. Off. | 220/771 |
| 6-199350 | 7/1994 | Japan | 220/771 |

*Primary Examiner*—Nathan J. Newhouse
*Attorney, Agent, or Firm*—Daniel S. Ortiz

[57] ABSTRACT

A portable container for fuel is provided which has a sealable opening sufficiently large to permit access to the interior for a swab or cleaning device to wipe or vacuum the interior of the container.

16 Claims, 9 Drawing Sheets

HAND PORTABLE FUEL CONTAINER WITH CLEANING OPENING

CROSS REFERENCE TO RELATED APPLICATIONS

This application is a continuation-in-part of U.S. application Ser. No. 08/699,144 filed Aug. 16, 1996, now abandoned, the contents of which are incorporated herein by reference.

RIGHTS UNDER FEDERALLY SPONSORED RESEARCH

Not applicable.

BACKGROUND OF THE INVENTION

Field of the Invention

The invention relates to portable fuel tanks or containers used in marine environments. Particularly, the invention is an improved fuel container for use with outboard motors or other small engines used in marine environments.

Fuel tanks for use in marine environments and particularly for small outboard motors generally carry about three to about eight gallons of gasoline. The fuel tanks generally have a handle to carry the fuel tank, a closeable opening for filling the tank with fuel and a second opening to which the fuel line to the motor is connected.

As is well known, in marine environments, due to high humidity and breathing of the tank due to changes in temperature and depletion of fuel, moisture can enter the fuel tank. In addition, certain materials in the fuel can polymerize. Because of the various factors, some of which are uncertain, solid or semisolid materials tend to accumulate in the fuel tank. The solid and semisolid materials collect in the fuel tank and pass through the fuel line to the motor where they are collected in the fuel filter causing the need for frequent filter replacement. Periodically it is necessary to empty the fuel from the tank and remove the contamination.

Removing the contamination and particularly material sticking to the surfaces of the fuel tank from currently available fuel tanks is difficult and environmentally polluting. Since the tank has only one or two small openings (one to two inch diameter), it is not a simple process to remove the material adhering to the walls of the fuel tank. One cannot easily clean the tank by wiping the inside of the tank with a rag or some other material and discarding the absorbent material in an environmentally friendly manner. Generally the fuel tank is inverted and as much material as possible poured on the ground or the fuel tank is washed with water or water and detergent and the water mixture poured onto the ground. This method, the only practical way to clean the fuel tanks, causes environmental pollution, particularly in areas where outboard motors are used or fueled.

It would be an improvement to have a fuel tank which had access to the interior through which a hand and arm or a relatively large absorbent swab could enter so that the interior could be cleaned in an environmentally acceptable manner.

RELATED ART

Small tanks generally have one or two small openings for entry and discharge of the liquid contents (see EP 235, 348A, U.S. Pat. No. 4,541,529). However, there is generally no access provided for introducing large objects into the tank.

Small containers (about two gallons or less capacity) have been designed to collect oil drained from automobiles for the home mechanics. The small containers such as shown in U.S. Pat. No. 4,632,268 and U.S. Pat. No. 4,823,947 are of a flat design, so that they can be placed under the oil drain of an automobile to collect the oil as it drains from the automobile. The oil collecting and dispensing containers generally have a large opening on a major surface of the container so that the oil can easily enter the container as it drains from the automobile. The container has a second smaller opening on a small end surface of the container so that the contents of the container can be emptied. The containers generally measure about a foot or less on a side and are about three to four inches deep. The containers would not be useful as a fuel container or tank for use on a boat due to the danger of fuel leaking from the large opening when the container was placed in an upright position and connected to the fuel line of the boat engine.

SUMMARY OF THE INVENTION

According to the invention a generally rectangular or cylindrical portable container is provided having at least one small opening, and a large opening on a top surface. Preferably the container has at least two small openings and a large opening on the top surface of the container. The container has a handle for hand carrying the preferably arranged on the top surface of the container.

DETAILED DESCRIPTION OF THE INVENTION

Figure 1:
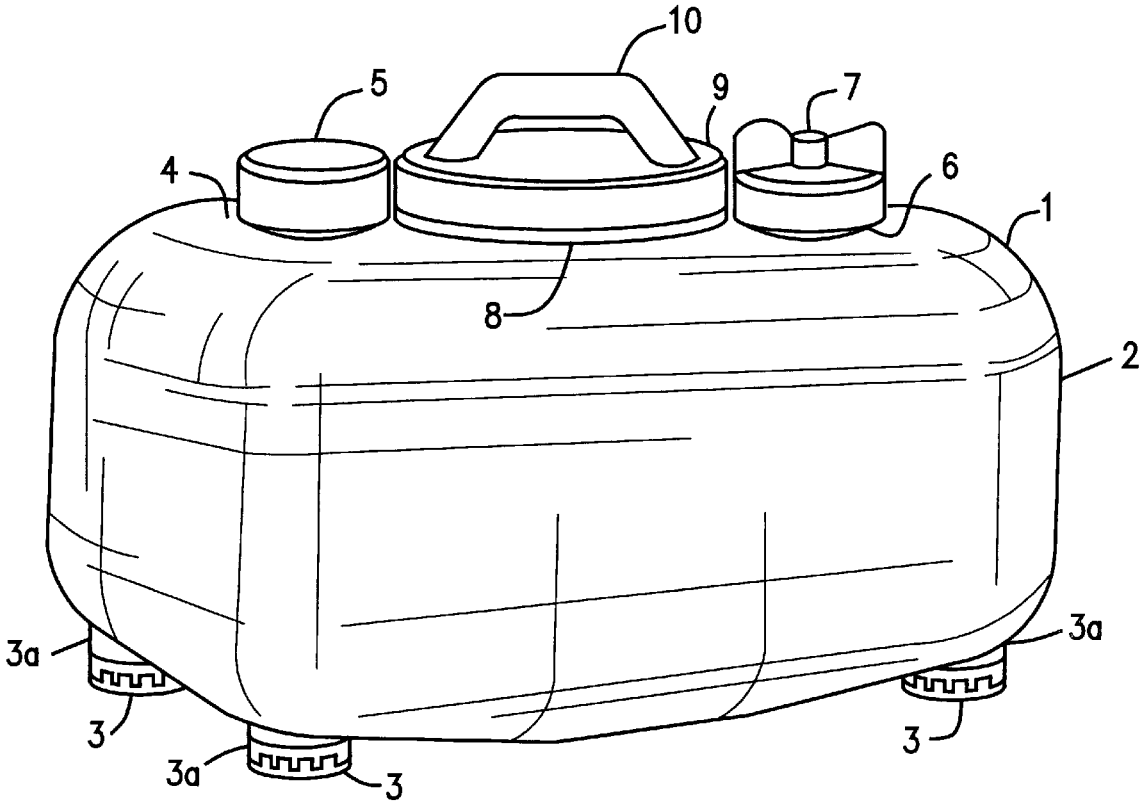
FIG. 1 is a view in perspective of an embodiment of a container showing two small outlets and a large opening.

The invention is a substantially rectangularly or cylindrically shaped hand portable container having at least one small opening and a large opening on a top surface of the container when the container is in its in-use position. The container generally has a handle or hand grip which can be located on the top surface or at an end portion.

As used herein, a small opening is an opening which is sufficiently large to easily introduce the fuel into the container or to remove the fuel from the container. Generally the small openings are in the range of about 0.5 inches to about 2.5 inches in diameter.

The large opening is sufficiently large to permit an absorbent swab to be easily inserted into the container and moved about to clean the contaminants from the interior of the container, The large opening is preferably sufficiently large to permit a hand holding a swab and a forearm to enter the container. Generally the large opening is from about 3.5 inches to about 8.5 inches in diameter, preferably from about 4 to about 7 inches in diameter and most preferably from about 4.5 to about 6 inches in diameter.

The large opening is at least large enough so that an absorbent swab on a handle or extension can be inserted into the container and moved about to clean the contamination from the container. Preferably the large opening is sufficiently large that a hand and forearm carrying an absorbent swab can be easily inserted into the container and easily moved about to wipe and clean the interior of the container.

The container is hand carryable or portable. The container has a handle which can be gripped to move the container from one location to another. The handle can be located on the top of the container or at an end or side. The handle can be a flexible arrangement which can be attached to lugs arranged on the container or can be foldable to lie flat against a surface of the container.

The container is readily carryable so it cannot be too large. Generally the container will hold from about 3 gallons to about 9 gallons and preferably from about 4.5 to about 8 gallons and most preferably from about 5 to about 7 gallons of fuel. The container is generally rectangular in shape so that it is stable when placed on a flat surface and will not tip over when subjected to motions encountered on a moving boat and particularly a small fast moving boat. However, the container can have a circular cylindrical shape with a flat or domed top as long as the bottom of the container presents a large area in relation to the height of the container so that it is stable and does not tip over easily.

The container can be made from metal or a polymeric material which is impervious to the fuel. In view of its light weight and fuel impermeability, the container can be made from a thermoplastic material by a blow molding process. A blow molded container is strong and light weight so that it can be easily carried by a single person when filled.

The containers of the invention can be designed to be readily stackable by proper arrangement, design and location of the large and small openings and the handle.

FIG. 1 is an isometric view of a container of the invention. Container 1 comprises a body 2 which can be made of a blow molded thermoplastic. The body rests on four feet 3, of which only three are shown. The feet comprise a non-slip material. The non-slip feet 3 are attached to protrusions 3a. The container comprises two small openings 4 and 6 and a large opening 8 arranged on the top side of the container. The two small openings and the large opening are closed by closure or cap means 5, 7 and 9 respectively. The openings 4, 6 and 8 extend above the top surface of the container and have thread means on the outside. The caps 5, 7 and 9 have thread means arranged on the interior of the cylindrical surface to engage the thread means on the outside surface of extended cylindrical openings 4, 6 and 8. Generally, the closure of one small opening comprises means for connection to a flexible fuel line to the motor (shown in FIG. 9).

Cap or closure means 9 has a handle means 10 arranged thereon. The closure means 9 and extended opening 8 must be sufficiently strong to support the weight of the filled container when the handle is grasped to move the container.

Feet 3 are fabricated of a non-slip material such as a rubber-like polymeric material which can be reinforced. The feet 3 are attached to protrusions 3*a* of tank body As shown in FIG. 1 the body 2 has a sloping bottom which permits the fuel to flow to a low spot to be fully removed from the tank. In addition, the bottom surface is preferably smooth without voids and indentations so that it can be easily wiped clean.

Figure 2:
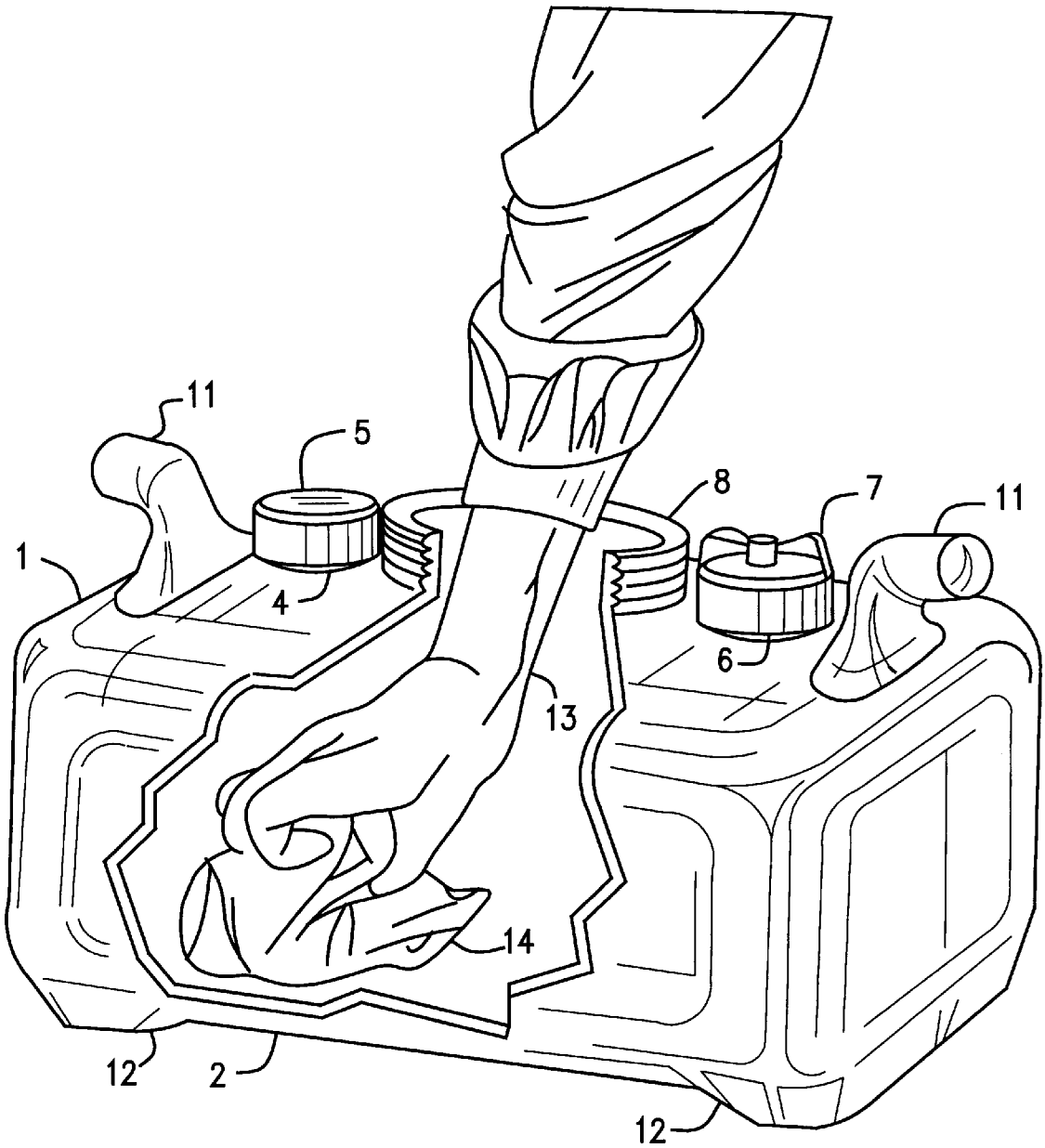
FIG. 2 is a view in perspective, partially cut away of a container, with a hand with a swab inserted through the large opening.

FIG. 2 is an isometric drawing of a container of the invention, partially cut away, to show a hand with an absorbent swab wiping the interior of the container through the large opening. The same numbers will be used to denote the same element as shown in FIG. 1 even though the body of the container has a different shape.

FIG. 2 shows a container 1 having a body 2 with supports 12 and extended openings 4, 6, and 8. The extended small openings 4 and 6 are capped with threaded closure means 5 and 7. The closure means for opening 8 has been removed so that a hand and forearm shown as 13 carrying a swab 14 for wiping the inside of the container can enter the container and move to contact the inside of the container.

Figure 3:
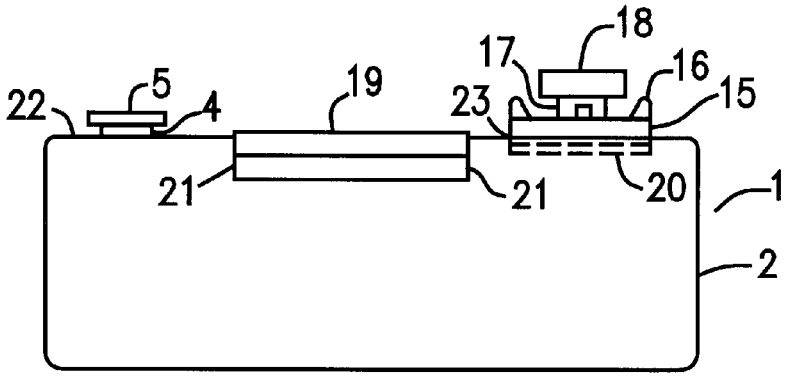
FIG. 3 is a side view of an embodiment of a fuel container of the invention.
Figure 4:
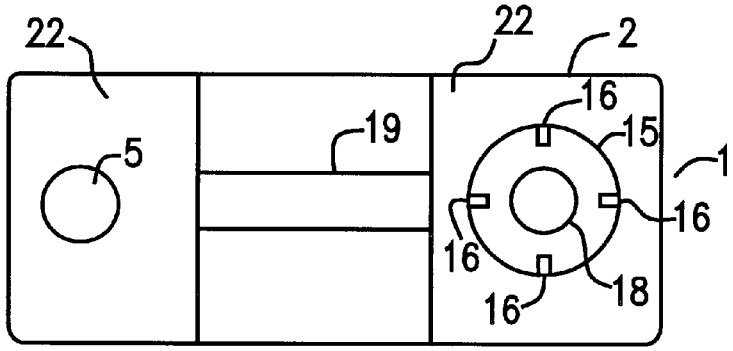
FIG. 4 is a top view of the container of FIG. 3.

FIGS. 3 and 4 show container 1 having body 2 with an extended small opening 4 with closure 5 on a portion of raised surface 22. A large closure means 15 is shown with thread means 20 on the inside of large opening 23. The thread means 20 extends into the body 2 of container 1. Lugs 16 project from the surface of closure means 15 to permit gripping the closure means 15 to open or tighten the closure.

An extended small opening 17 with closure 18 extends from the closure means 15. The closure means are shown as threaded means 20. However, other means such as snap closures and the like can be used. However, since threaded means are simple and reliable, they are preferred. When only one small opening is provided, opening 4 and closure 5 can be eliminated making the container much simpler to fabricate.

Shoulders 21 provide a valley between raised surfaces 22. The valley is spanned by handle means 19. As can be seen the valley is asymmetric in relation to the ends of the container. Asymmetric arrangement of the handle may be required in this arrangement when the large opening cannot be arranged on the top surface of the container without asymmetric location of the handle due to the size of the container and the size of the large opening. However, asymmetric arrangement of the handle is not required.

Figure 5:
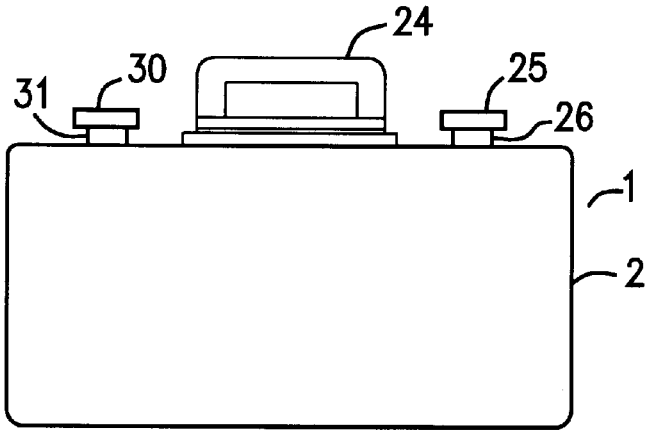
FIG. 5 is a side view of a container having a large cap with a handle and external threads.
Figure 6:
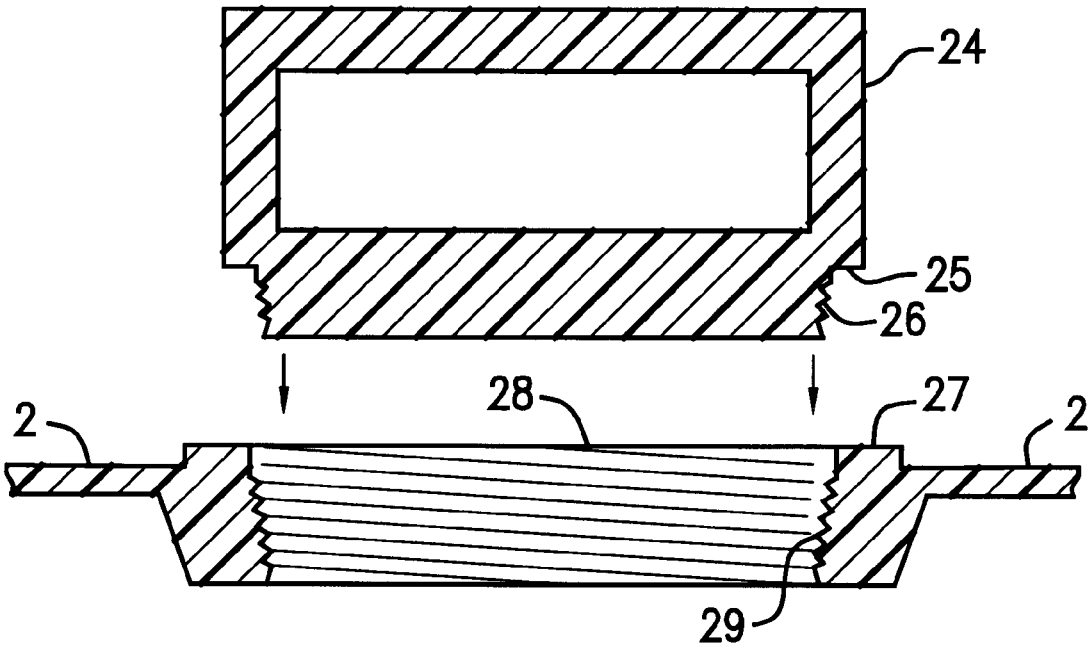
FIG. 6 is a side view of the large cap of FIG. 5.
Figure 7:
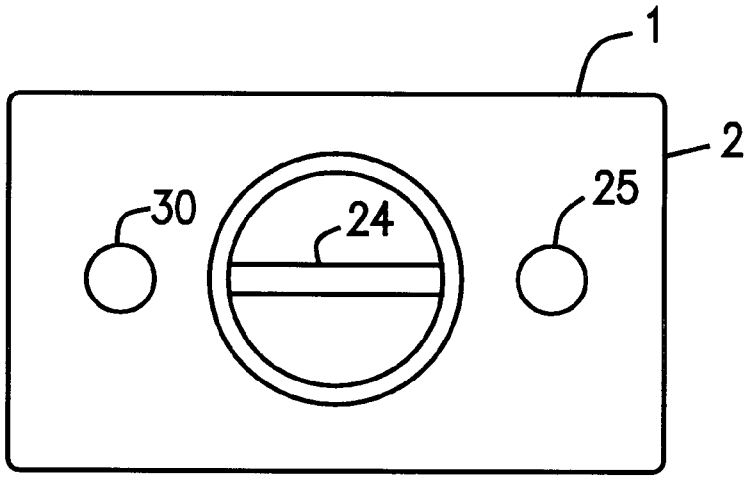
FIG. 7 is a top view of the container of FIG. 5.

FIG. 5, 6 and 7 illustrate an embodiment of the invention having a large opening 28 with internal threads 29 and a closure-handle 24. The container 1 comprises body 2 with two small openings 26 and 31 closed by cap means 25 and 30 respectively.

The large opening 28 is sealingly closed by combined closure-handle means 24. The closure-handle means 24 has an outside threaded portion 26 and a shoulder 25. The outside threads mate with inside threads 29 of large opening 28. The shoulder 25 of closure-handle means 24 can sealingly engage land 27 which surrounds large opening 28. The body 2 of container 1 can be reinforced in the area of the large opening 28.

If a tight seal is desired, in addition to mating of shoulder 25 with land 27, a tapered thread arrangement between threads 26 and 29 can be incorporated into the design as shown. However, tapered threads are not required. The container shown in FIGS. 5, 6 and 7 can be easily fabricated from blow-molding a thermoplastic resin. Which resin should be impervious to the fuel.

Figure 8:
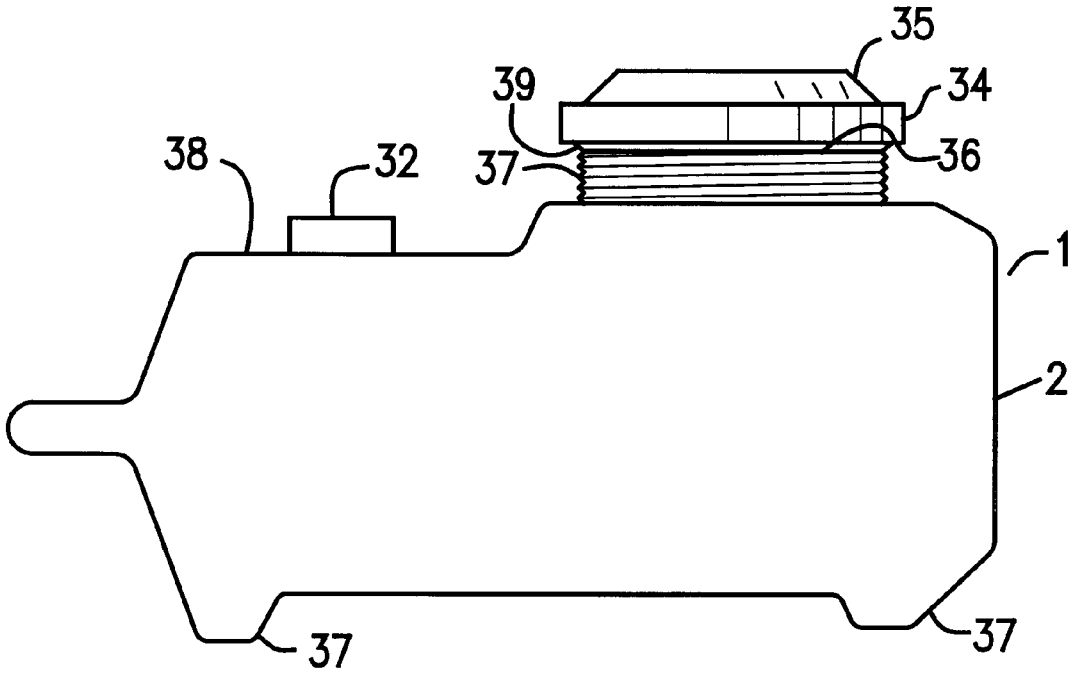
FIG. 8 is a side view of a TEMPO™-style container having a large opening and a handle on an end.
Figure 9:
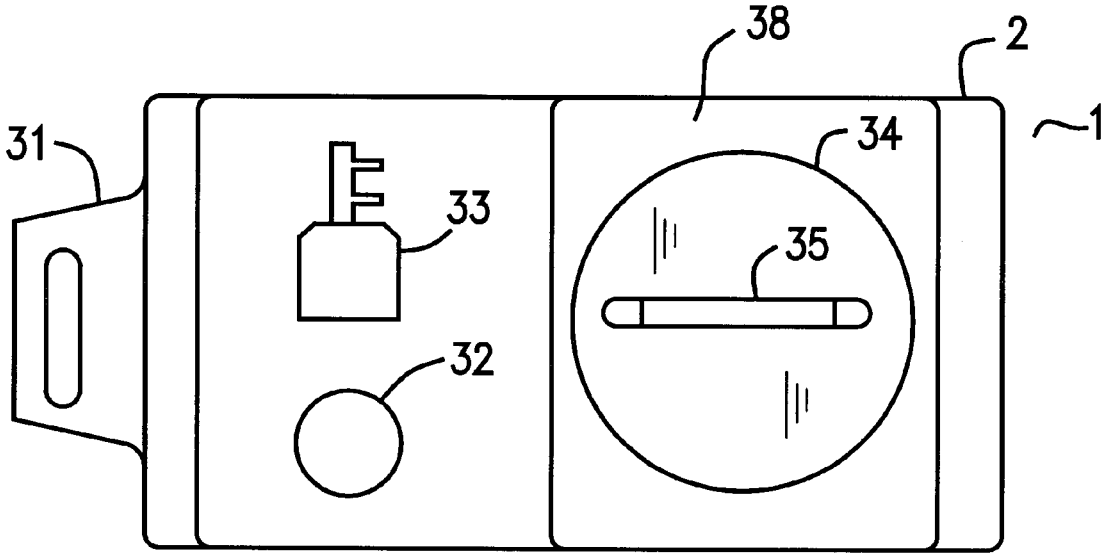
FIG. 9 is a top view of the container of FIG. 8.

FIGS. 8 and 9 illustrate a TEMPO™-style fuel container having a large opening for access to the inside of the fuel container for cleaning. The container 1 comprises a body 2 supported on feet 37. The top side 38 of the container has mounted thereon a small opening capped with closure, 32 which can be internally threaded into the top surface 3 8 of body 2 of container 1 for filling the container with fuel. A second small opening capped by means 33 provides for connection of the fuel line to the motor.

The container has a large opening 36 which has external threads 37 to engage internal threads of closure means 34. Closure means 34 must provide a fuel tight seal since the large opening 36 is at a lower portion of the container when the container is being transported by grasping handle 31 on a side of body 2. The handle 31 permits transport of the container 1 in a more comfortable carrying position.

The fuel tight seal of large opening 36 by closure means 34 can be insured by incorporation of a gasket in closure means 34 or by interaction between the closure means 34 and an edge 39 of large opening 36.

The closure 34 has a grasping means 35 shown as a ridge so that one can grasp the ridge 35 to apply torque to open the large opening when container cleaning is required. Other means such as wing-like projections or holes in the closure means which can be engaged with a tool to apply torque to the closure means to remove closure means 34 for access to the inside of the container 1.

Figure 10:
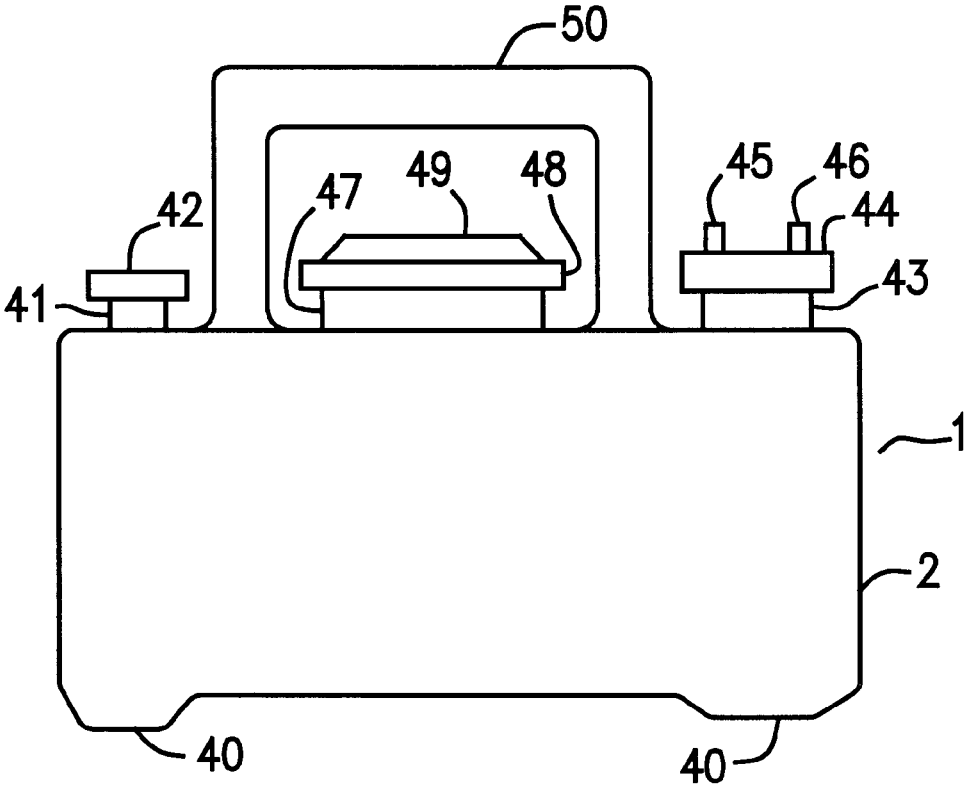
FIG. 10 is a side view of an embodiment of the invention.
Figure 11:
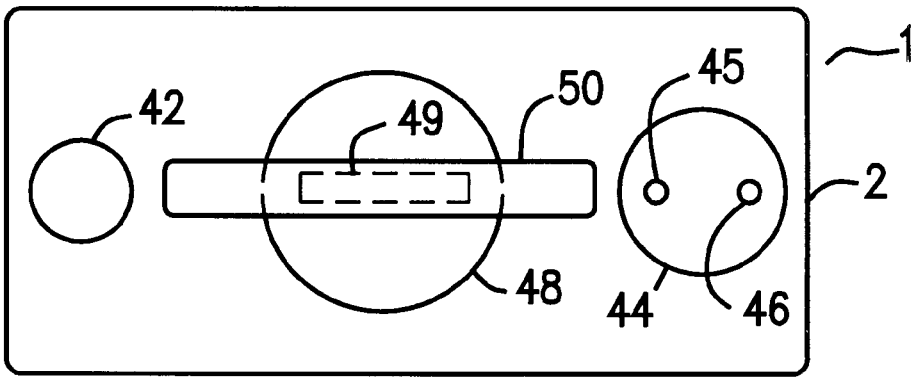
FIG. 11 is a top view of the embodiment of the container of FIG. 10.
Figure 12:
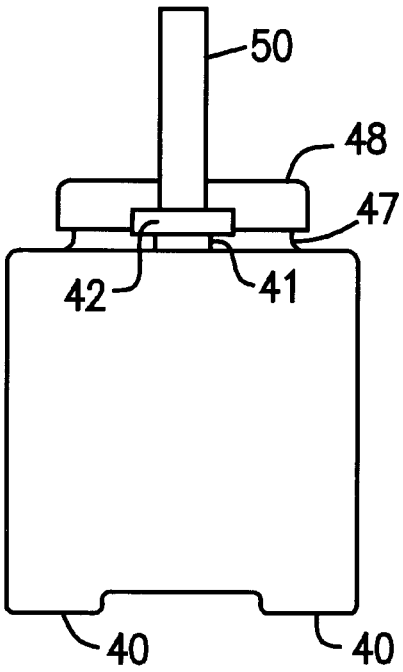
FIG. 12 is a view from the left side of the container of FIG. 10.

FIGS. 10, 11 and 12 illustrate an embodiment of the invention having the large opening inside the area of the handle. Container 1 has body 2 with feet 40. Feet 40 comprise four separate feet which do not extend completely across the bottom of body 2. The container has a small opening 41 capped with closure 42 for filling the container with gasoline and small opening 43 with closure means 44 having connection means 45 and 46 for connection to the flexible fuel line to supply fuel to the outboard motor.

The container has a large opening 47 capped with closure means 48 for access to the interior of the container. Closure means 48 has a ridge 49 to grasp to apply torque to remove closure means 48. Body 2 of container 1 has a carrying handle integral with body 2 which extends over large opening 47. The handle should be arranged sufficiently distant from large opening 47 to permit easy access to the interior for cleaning.

Figure 13:
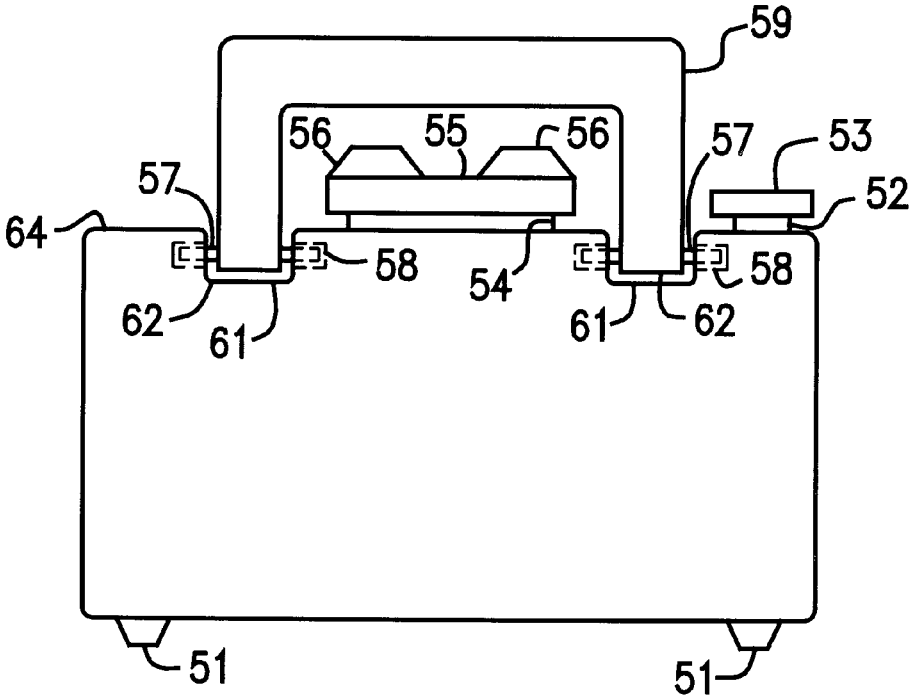
FIG. 13 is a side view of a container having a movable handle.
Figure 14:
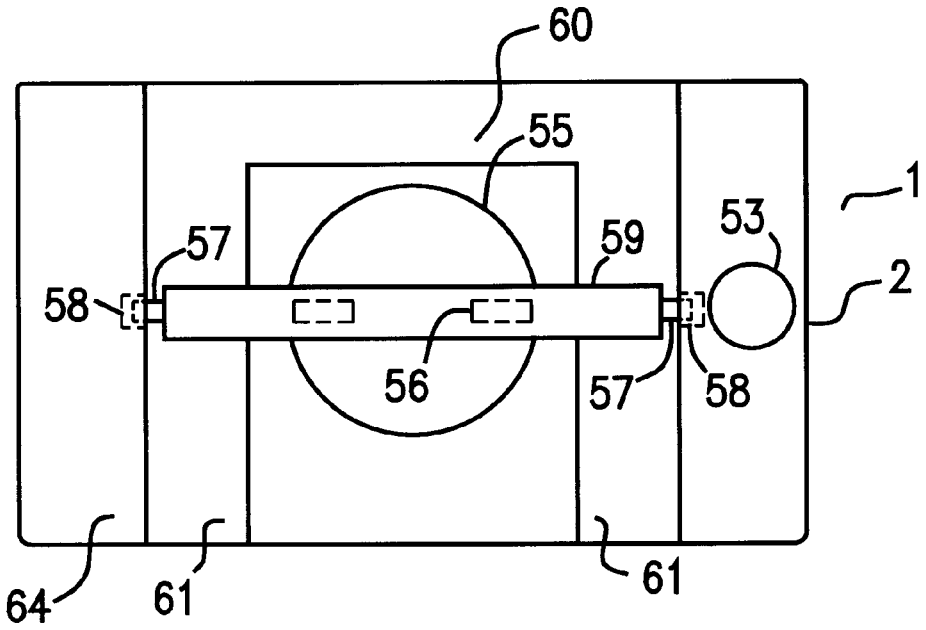
FIG. 14 is a top view of the container of FIG. 13 with the movable handle in an upright position.
Figure 15:
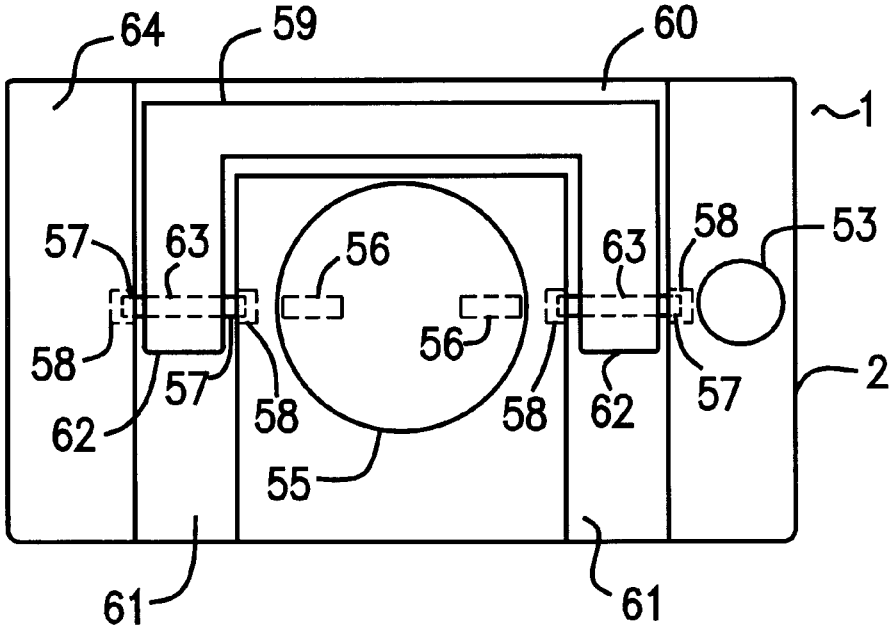
FIG. 15 is a top view of the container of FIG. 13 with the handle rotated to be flat against the container.

In an alternate arrangement, as shown in FIGS. 13, 14 and 15, the container has a movable handle which can be arranged to be flat against the container when not in use to provide ready access to the interior of the container.

As shown in FIGS. 13, 14 and 15, container 1 comprises body 2 with feet 51. The top side of the container has a single small opening 52 capped with closure means 53. The single small opening can be arranged to be used to fill the container with fuel and provide for means to connect the container to the fuel line to the motor or the large opening can be used to introduce fuel into the container. A second small opening can also be positioned on the top surface of the container to provide separate filling and fuel feed openings if desired.

The container has a large opening 54 capped with closure 55 having wing means 56 for easy opening of the closure 55 for access to the interior of the container for cleaning or fill with fuel. stop side of the container has channels 61 which provide a depression for access of ends 62 of handle 59 to a side portion of the channels 61. In the sidewalls of channels 61 are pin receiving openings 58 (shown in dotted lines). The openings 58 do not open into the interior of body 2 of container 1. The pin receiving openings 58 are blind holes which receive spring loaded pins 57 which extend through holes 63 (shown in dotted lines) in the portion of handle 59 near the bottom of channel 61.

FIGS. 13 and 14 show the container with the handle 59 extended in the carrying position.

FIG. 15 shows the container of FIGS. 13 and 14 when the handle 59 is in the not-in-use or stored position. Handle 59 is rotated toward the open portion 60 in the top surface 64 of the container. The open portion 60 can be contoured to receive the handle 59 in a manner that the handle does not extend beyond the surface 64 of the container.

A stackable container (not shown) can be provided if the large and small openings with their closures are flush or extend only a small distance above 64 which distance does not exceed the height of feet 51. Various depressions can be provided in the bottom of the container to accommodate the small and large openings closure and in the top surface of the container to accommodate the feet to prevent slipping of the stacked containers.

The upper or top surface of the container (when in the use position) can comprise openings of various diameters with closures. Small vents (less than about 0.5 inches in diameter) with snap closures can be provided as a vent hole when filling or emptying fuel. The large opening can be used as a fuel filling opening. This arrangement requires only one small opening for discharge of fuel from the container to the motor. A small vent opening with a snap or twist closure can also be provided.

Figure 16:
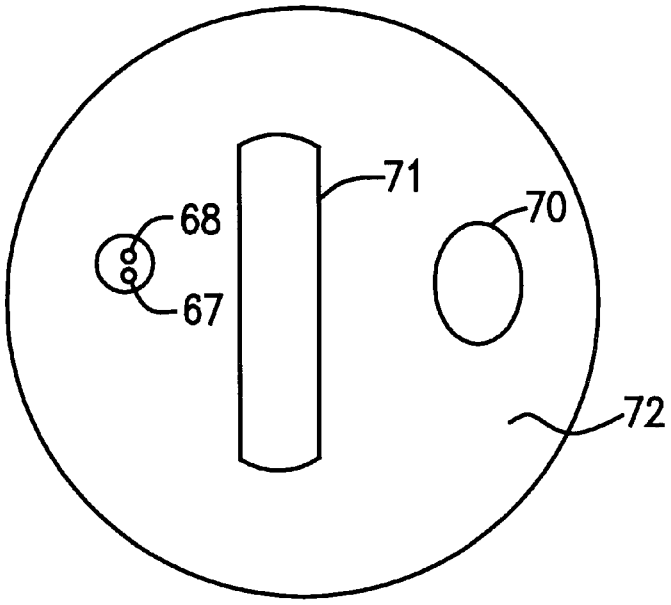
FIG. 16 is a top view of a cylindrical container of the invention.
Figure 17:
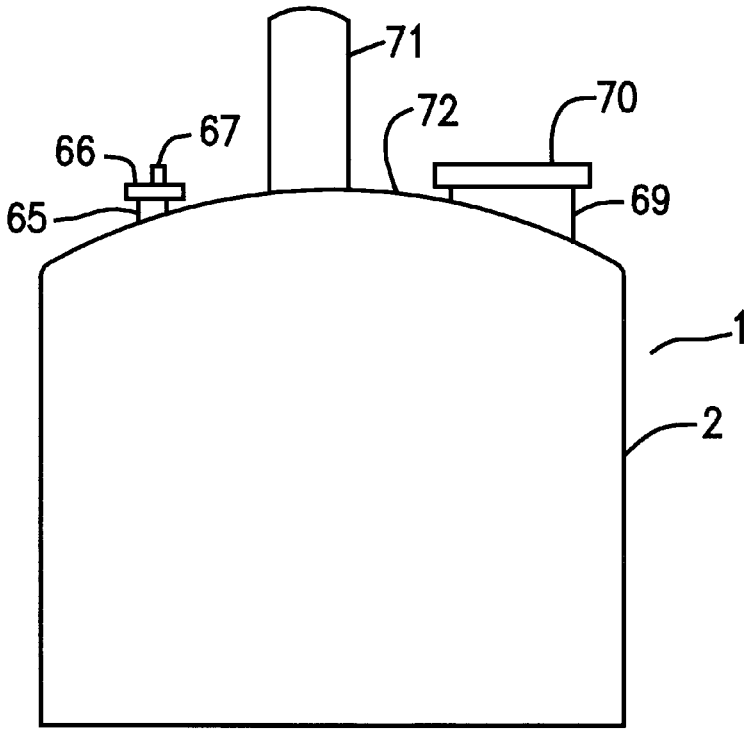
FIG. 17 is a side view of the container of FIG. 16.

FIGS. 16 and 17 illustrate an embodiment of the invention wherein the body 2 of container 1 comprises a cylindrically-shaped container having a domed upper surface 72. Domed surface 72 has arranged thereon small opening 65 with closure means 66 having fuel line connections 67 and 68 arranged thereon. Large opening 69 is capped with closure means 70. Handle 71 is mounted on container dome 72.

Preferably, closure means, particularly the closure means for the large opening, should comprise means for preventing water which may accumulate on the closure means from entering the container. This can be accomplished by providing a threaded closure with threads on the inside cylindrical surface. In the alternative, the closure means can be designed with a slight convex upward surface so that water does not accumulate.

The container access can be used to remove the contamination by a suction device such as an aspirator.

I claim:

1. A portable single chamber fuel container for a marine engine which comprises: a container body having a bottom, sides and a top defining an entire interior of the container, a small opening having a closure means comprising a connector for a fuel line for the engine, a large opening, the openings arranged on the top, the large opening having closure means, and the container having a gripping and carrying means arranged to facilitate movement of the container, wherein the large opening is of sufficient size to permit manual cleaning of the interior of the container by insertion of a cleaner's hand.

2. The container of claim 1 wherein the gripping and carrying means comprises a portion of the closure means for the large opening.

3. The container of claim 1 wherein the body is substantially rectangular.

4. The container of claim 1 wherein the gripping and carrying means is arranged on one side of the body.

5. The container of claim 1 wherein the body is supported by feet having a non-slip surface which contact a support on which the container rests.

6. The container of claim 1 wherein the small opening is from about 0.5 inches to about 2.5 inches in diameter.

7. The container of claim 1 wherein the gripping and carrying means is arranged on the top of the body.

8. The container of claim 1 wherein an inside bottom surface of the container, in the use position, slopes in at least one direction to a low point.

9. The container of claim 8 having non-slip feet.

10. The container of claim 1 having a capacity of from about 3 to about 9 gallons.

11. The container of claim 10 having a capacity of from about 3 to about 6 gallons.

12. The container of claim 1 wherein the large opening is from about 3.5 inches to about 8.5 inches in diameter.

13. The container of claim 12 wherein the small opening is from about 0.5 inches to about 2.5 inches in diameter.

14. The container of claim 1 wherein the container has at least one additional small opening arranged on the top of the body.

15. The container of claim 14 wherein the closure means is a threaded closure means.

16. The container of claim 14 wherein said at least two small openings are from about 0.5 inches to about 2.5 inches in diameter.

* * * * *